US011668121B2

(12) United States Patent
Nam et al.

(10) Patent No.: US 11,668,121 B2
(45) Date of Patent: Jun. 6, 2023

(54) MOTOR-DRIVEN DOOR LATCH FOR VEHICLE

(71) Applicants: Hyundai Motor Company, Seoul (KR); Kia Motors Corporation, Seoul (KR); Pyeong Hwa Automotive Co., Ltd., Daegu (KR)

(72) Inventors: Jinwoo Nam, Seoul (KR); Kyoung Taek Kwak, Yongin-si (KR); Jungho Han, Seoul (KR); Hyuk Noh, Daegu (KR); Jung-Ho Park, Daegu (KR); Ki Ryun Ahn, Daegu (KR); Jin-Bok Lee, Anyang-si (KR); Ji-Woo Joo, Hwaseong-si (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 375 days.

(21) Appl. No.: 16/923,162

(22) Filed: Jul. 8, 2020

(65) Prior Publication Data

US 2021/0025204 A1 Jan. 28, 2021

(30) Foreign Application Priority Data

Jul. 26, 2019 (KR) ..... 10-2019-0090701

(51) Int. Cl.
*E05B 81/90* (2014.01)
*E05B 77/10* (2014.01)
(Continued)

(52) U.S. Cl.
CPC ..... *E05B 81/90* (2013.01); *E05B 77/10* (2013.01); *E05B 77/12* (2013.01); *E05B 77/38* (2013.01);
(Continued)

(58) Field of Classification Search
CPC ..... E05B 77/02; E05B 77/12; E05B 77/36; E05B 77/38; E05B 81/06; E05B 81/14;
(Continued)

(56) References Cited

U.S. PATENT DOCUMENTS 5,020,838 A 6/1991 Fukumoto
6,081,758 A * 6/2000 Parvulescu ..... B60K 28/14 701/45
(Continued)

FOREIGN PATENT DOCUMENTS

CN 106869641 A 6/2017
DE 3932268 A1 6/1990
(Continued)

OTHER PUBLICATIONS

European Patent Office, Extended European Search Report issued in corresponding European Application No. 20184675.5, dated Dec. 22, 2020, 9 pages.

*Primary Examiner* — Kristina R Fulton
*Assistant Examiner* — Noah Horowitz
(74) *Attorney, Agent, or Firm* — Slater Matsil, LLP

(57) ABSTRACT

A motor-driven door ratchet includes a catch part configured to lock a vehicle door to a vehicle body by being caught by a striker mounted on the vehicle body. A door locking and release part includes a main motor and is configured to allow the catch part to be locked or released from the striker. An inside emergency operation lever is connected to an inside handle installed in the vehicle door and is configured to be rotated by receiving a manipulation force to allow the vehicle door to be opened by applying torque to the catch part. An outside emergency operation lever is connected to an outside handle installed in the vehicle door and is
(Continued)

configured to be rotated by receiving a manipulation force to allow the vehicle door to be opened by applying torque to the catch part.

20 Claims, 7 Drawing Sheets

(51) Int. Cl.

| | |
|---|---|
| ***E05B 77/38*** | (2014.01) |
| ***E05B 81/06*** | (2014.01) |
| ***E05B 81/16*** | (2014.01) |
| ***E05B 81/56*** | (2014.01) |
| ***E05B 81/76*** | (2014.01) |
| ***E05B 85/06*** | (2014.01) |
| ***E05B 77/12*** | (2014.01) |

(52) U.S. Cl.
CPC ..... *E05B 81/06* (2013.01); *E05B 81/16* (2013.01); *E05B 81/56* (2013.01); *E05B 81/76* (2013.01); *E05B 85/06* (2013.01); *E05Y 2900/531* (2013.01)

(58) Field of Classification Search
CPC ..... E05B 81/16; E05B 81/18; E05B 81/20; E05B 81/34; E05B 81/36; E05B 81/40; E05B 81/56; E05B 81/76; E05B 81/90; E05B 85/06; E05B 85/20; E05B 85/24; E05B 85/243; E05B 85/26
See application file for complete search history.

(56) References Cited

U.S. PATENT DOCUMENTS

| | | | | |
|---|---|---|---|---|
| 8,474,888 | B2 * | 7/2013 | Tomaszewski | E05B 77/30 292/216 |
| 9,043,082 | B2 * | 5/2015 | Kouzuma | E05B 77/12 701/36 |
| 10,125,524 | B2 * | 11/2018 | Kouzuma | E05B 81/14 |
| 10,358,845 | B2 * | 7/2019 | Yokomori | E05B 81/58 |
| 10,378,252 | B2 * | 8/2019 | Ottino | E05B 81/68 |
| 11,035,156 | B2 * | 6/2021 | Damboiu | E05B 81/14 |
| 11,085,204 | B2 * | 8/2021 | Ichinose | E05B 77/32 |
| 11,441,336 | B2 * | 9/2022 | Nam | E05B 81/80 |
| 2011/0204673 | A1 | 8/2011 | Cumbo et al. | |
| 2016/0076277 | A1 | 3/2016 | Kouzuma et al. | |
| 2016/0244999 | A1 | 8/2016 | Ottino et al. | |
| 2017/0167170 | A1 | 6/2017 | Seo et al. | |
| 2018/0371805 | A1 * | 12/2018 | Ichinose | E05B 77/12 |
| 2019/0017301 | A1 * | 1/2019 | Cumbo | E05B 81/20 |
| 2020/0224465 | A1 * | 7/2020 | Nagaoka | E05B 79/20 |
| 2021/0189773 | A1 | 6/2021 | Scholz et al. | |

FOREIGN PATENT DOCUMENTS

| | | | |
|---|---|---|---|
| DE | 19547724 | A1 | 6/1997 |
| DE | 202008003845 | U1 | 8/2009 |
| DE | 102017124518 | A1 | 4/2019 |
| JP | 2020090828 | A | 6/2020 |
| WO | 2019076402 | A1 | 4/2019 |
| WO | 2020115939 | A1 | 6/2020 |

* cited by examiner

MOTOR-DRIVEN DOOR LATCH FOR VEHICLE

CROSS-REFERENCE TO RELATED APPLICATIONS

This application claims priority to Korean Patent Application No. 10-2019-0090701, filed in the Korean Intellectual Property Office on Jul. 26, 2019, which application is hereby incorporated herein by reference.

TECHNICAL FIELD

The present invention relates to a motor-driven door ratchet for a vehicle.

BACKGROUND

In general, a motor-driven door latch for a vehicle is configured to lock or release a door to or from a vehicle body by using a motor for user convenience.

In addition, inside and outside handles are respectively installed on the inside and outside of the door such that a user can easily operate the vehicle door by gripping it, and a switch or the like is provided in the vehicle door in order to lock or release a motor-driven door latch.

However, in such a conventional motor-driven door latch structure, a structure or a device for releasing a door locked state through an appropriate door unlocking means is required when inoperability of a motor is caused due to a collision accident of a vehicle or discharge of a battery.

The above information disclosed in this Background section is only for enhancement of understanding of the background of the invention, and therefore it may contain information that does not form the prior art that is already known in this country to a person of ordinary skill in the art.

SUMMARY

The present invention relates to a motor-driven door ratchet for a vehicle. Particular embodiments relate to a motor-driven door ratchet for a vehicle capable of unlocking a door by using an emergency motor when a door opening and closing motor is inoperable.

Embodiments of the present invention can provide a motor-driven door ratchet for a vehicle capable of releasing a door locked state when a door-opening and closing motor becomes inoperable due to a collision accident of a vehicle or discharge of a battery. Embodiments can improve producibility and safety of the vehicle by allowing the vehicle to be unlocked conveniently by a key operation.

An exemplary embodiment of the present invention provides a motor-driven door ratchet that includes a catch part configured to lock a vehicle door to a vehicle body by being caught by a striker mounted on the vehicle body or to be detached from the striker to allow the door to be opened from the vehicle body. A door locking and release part is configured to include a main motor to allow the catch part to be locked or released from the striker by applying a rotational force to the catch part through the main motor. An emergency door release part is configured to include an auxiliary motor to allow the auxiliary motor to be operated to open the vehicle door from the vehicle body through the catch part. An inside emergency operation lever is connected to an inside handle installed in the vehicle door to be rotated by receiving a manipulation force, to allow the vehicle door to be opened by applying torque to the catch part. An outside emergency operation lever is connected to an outside handle installed in the vehicle door to be rotated by receiving a manipulation force, to allow the vehicle door to be opened by applying torque to the catch part.

The catch part may include a catch configured to be rotatably installed to have a locking groove through which the striker mounted on the vehicle body is inserted to be caught or is removed; and a pawl rotatably mounted to enter a rotation trajectory of the catch to stop rotation of the catch or to deviate from the rotation trajectory of the catch to allow the catch to be freely rotatable, and a pawl arm protruding from a first side surface is formed in the pawl.

The door ratchet may further include a first bumper configured for damping and rotation stopping of the catch when the striker is inserted into the locking groove of the catch.

The door ratchet may further include a second bumper configured for damping and rotation stopping of the pawl during rotation of the pawl.

The catch and the pawl may be rotatably mounted to a support bracket through pins, and an extension arm may be formed in the support bracket.

The door locking and release part may include the main motor configured to be rotatable in a clockwise and counterclockwise direction to include a first driving gear; a first driven gear engaged in the first driving gear, and a pawl release lever configured to include a second driven gear engaged in the first driven gear to rotate the pawl while rotating through a driving gear of the main motor, the first driven gear, and the second driven gear.

The pawl release lever may include an opening protrusion and a closing protrusion spaced from each other in a circumferential direction, and the pawl arm may be disposed between the opening protrusion and the closing protrusion.

The door ratchet may further include a door latch controller configured to detect an operation of a button or a switch installed in the inside handle, the outside handle, or the vehicle door, and the door latch controller may detect manipulation of a button or a switch installed in the inside handle, the outside handle, or the vehicle door to apply an operation signal to the main motor.

The emergency door release part may include an emergency auxiliary motor configured to include a driving screw, a driven screw lever engaged with the driving screw to move according to rotation of the driving screw, an emergency key lever coupled to the driven screw lever to move together therewith, and a master locking link connected to the emergency key lever together therewith to be connected to the outside emergency operation lever.

A connection protrusion may be formed at a first end of the master rocking link, a hole into which the connection projection is inserted is formed at a first end of the emergency key lever, and the master locking link is not only connected to the emergency key lever to move together therewith, but is also relatively rotatably connected to the emergency key lever.

An operation protrusion may be provided at a first end of the master rocking link, and a long hole into which the operation protrusion is movably inserted may be formed in the outside emergency operation lever.

The door ratchet may further include a key nut coupled to a key cylinder into which a vehicle key is to be inserted, an accommodation groove wall for constituting an accommodation groove may be formed in a circumferential direction in the key nut, and a connection projection inserted into the accommodation groove of the key nut may be formed at a second end of the emergency key lever.

The inside emergency operation lever and the outside emergency operation lever may be rotatably fastened to an extension arm of the support bracket through pins.

A protruding arm protruding at a predetermined height may be formed in the inside emergency operation lever, and the protruding arm may be selectively pushed by the operation protrusion of the master locking link.

A length of the long hole of the outside emergency operation lever may be larger than a height of the protruding arm of the inside emergency operation lever.

The door latch controller may detect collision through a collision detection sensor to apply an operation signal to the auxiliary motor when the main motor is inoperable due to a collision accident of a vehicle.

In accordance with the motor-driven door ratchet according to an exemplary embodiment of the present invention, the vehicle door may be stably locked to the vehicle body by using the main motor, and the locked vehicle door may be smoothly released from the vehicle body so that the user can conveniently use the vehicle door.

When the main motor is inoperable due to a discharge or collision, etc., the door locked to the vehicle body may be released through the auxiliary motor and the inside handle or the outside handle, thereby improving the safety of the vehicle door.

When the main motor and the auxiliary motor are inoperable at the same time, the door locked to the vehicle body may be released using the vehicle key, thereby further improving the safety of the vehicle door.

BRIEF DESCRIPTION OF THE DRAWINGS

The drawings are intended to be used as references for describing the exemplary embodiments of the present invention, and the accompanying drawings should not be construed as limiting the technical spirit of the present invention.

Figure 1:
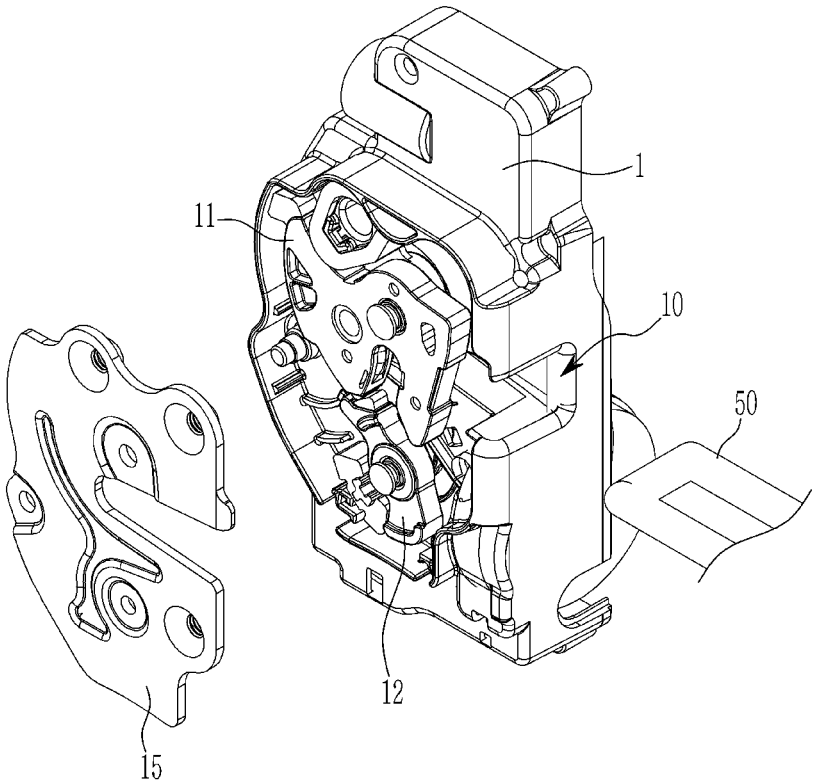
FIG. 1 illustrates a front view of a motor-driven door latch for a vehicle according to an exemplary embodiment of the present invention.
Figure 2:
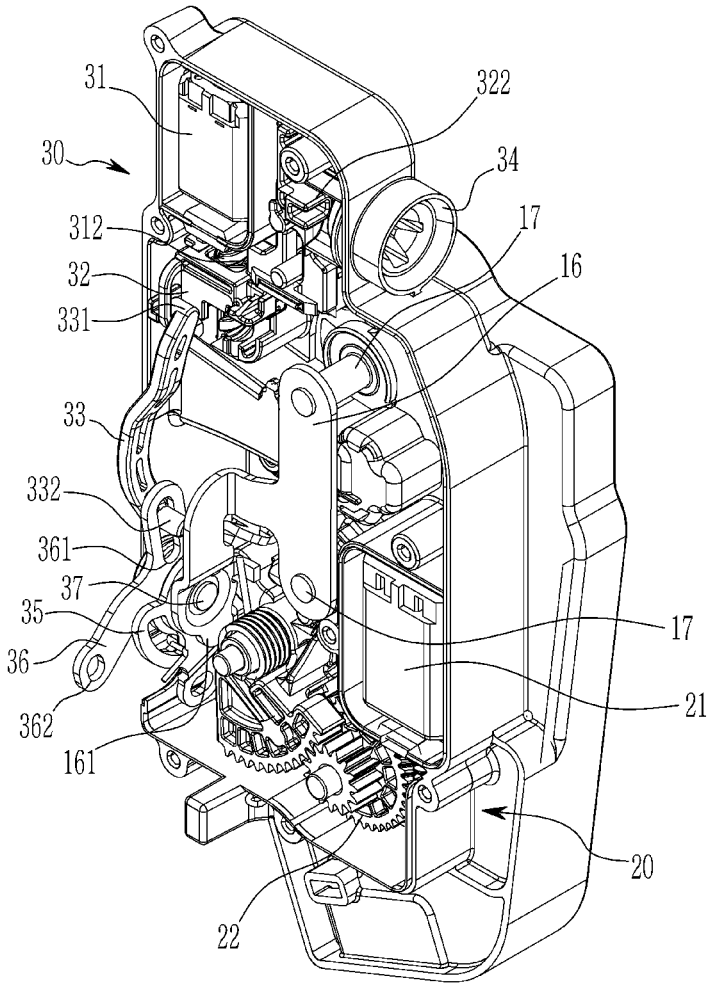
FIG. 2 illustrates a rear view of a motor-driven door latch for a vehicle according to an exemplary embodiment of the present invention.
Figure 3:
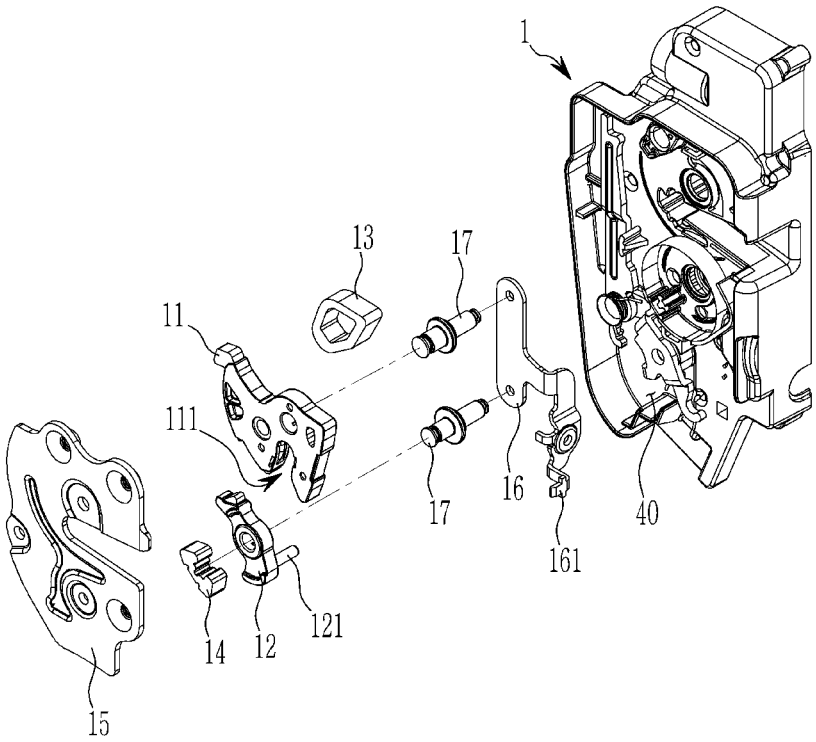
FIG. 3 illustrates an exploded perspective view of a catch part of a motor-driven door latch for a vehicle according to an exemplary embodiment of the present invention.
Figure 4:
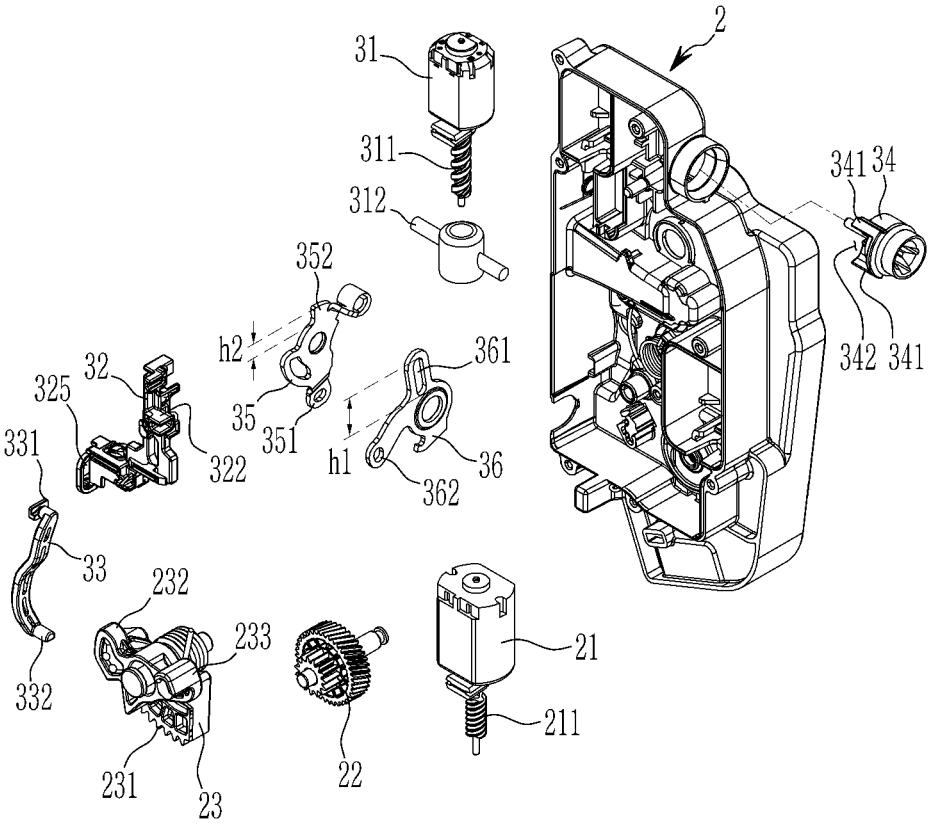
FIG. 4 illustrates an exploded perspective view of a door locking and release part and an emergency door release part of a motor-driven door latch for a vehicle according to an exemplary embodiment of the present invention.

The following reference symbols can be used in conjunction with the drawings.

1: base plate
2: cover
10: catch part
11: catch
12: pawl
20: door locking and release part
21: main motor
22: first driven gear
23: pawl release lever
30: emergency door release part
31: auxiliary motor
32: emergency key lever
33: master locking link
34: key lever
35: inside emergency operation lever
36: outside emergency operation lever

DETAILED DESCRIPTION OF ILLUSTRATIVE EMBODIMENTS

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention.

In order to clearly describe the present invention, parts that are irrelevant to the description are omitted, and identical or similar constituent elements throughout the specification are denoted by the same reference numerals.

Since the size and thickness of each configuration shown in the drawings are arbitrarily shown for convenience of description, the present invention is not necessarily limited to configurations illustrated in the drawings, and in order to clearly illustrate several parts and areas, enlarged thicknesses are shown.

In the following description, dividing names of components into first, second, and the like is to divide the names because the names of the components are the same, and an order thereof is not particularly limited.

In addition, throughout the specification, unless explicitly described to the contrary, the word "comprise" and variations such as "comprises" or "comprising" will be understood to imply the inclusion of stated elements but not the exclusion of any other elements.

Referring to FIG. 1 to FIG. 4, a motor-driven door ratchet for a vehicle according to an exemplary embodiment of the present invention includes: a catch part 10 configured to lock a vehicle door to a vehicle body by being caught by a striker 50 mounted on the vehicle body or to be detached from the striker 50 to allow the door to be opened from the vehicle body; a door locking and release part 20 configured to allow the catch part to be locked or released from the striker 50 by applying a rotational force to the catch part 10; and an emergency door release part 30 configured to allow the door locked to the vehicle body to be released from the vehicle body when the door locking and release part 20 is inoperative due to a battery discharge or a collision accident.

The catch part 10 may include: a catch 11 rotatably mounted on a first side surface of a base plate 1 to have a locking groove 111 through which the striker 50 mounted on the vehicle body is inserted or removed; and a pawl 12 rotatably mounted to the base plate 1 to enter a rotation trajectory of the catch 11 to stop rotation of the catch 11 or to deviate from the rotation trajectory of the catch 11 to allow the catch 11 to be freely rotatable.

The pawl 12 may include a pawl arm 121 protruded from a first side thereof.

In addition, when the striker 50 is inserted into the locking groove in of the catch 11, a first bumper 13 for damping and rotation stopping of the catch 11 may be mounted on the base plate 1 adjacent to the catch 11, and a second bumper 14 serving for damping and rotation stopping of the pawl 12 may be mounted on the base plate 1 adjacent to the pawl 12 during a rotational movement of the pawl 12.

An accommodation groove 40 for accommodating the catch 11 and the pawl 12 may be formed in the base plate 1, and a cover plate 15 for covering the accommodation groove 40 may be coupled to the base plate 1.

The catch 11 and the pawl 12 may be rotatably mounted to the base plate 1 through a support bracket 16 and a pin 17 penetrating it.

An extension arm 161 is integrally formed in the support bracket 16, and an inside emergency operation lever 35 and an outside emergency operation lever 36, which will be described later, are rotatably fastened to the extension arm to be supported.

The door locking and release part 20 and the emergency door release pall 30 are provided on a rear surface of the base plate 1, and a cover 2 may be additionally coupled to the base plate 1.

The door locking and release part 20 may include a main motor 21, a first driven gear 22, and a pawl release lever 23.

The main motor 21 is mounted to the base plate 1, is rotatable clockwise and anticlockwise, and includes a driving gear 211.

The first driven gear 22 is rotatably mounted to the base plate 1 and is engaged with the driving gear 211, and rotates together with the driving gear 211.

The pawl release lever 23 may be formed to have a generally circular arc shape, may be mounted to the base plate 1 to be rotatable clockwise and anticlockwise, and may include a second driven gear 231 engaged with the first driven gear 22.

The pawl release lever 23 may include an opening protrusion 232 and a closing protrusion 233 which are spaced apart from each other in a circumferential direction.

The pawl arm 121 may be disposed between the opening protrusion 232 and the closing protrusion 233.

Figure 5:
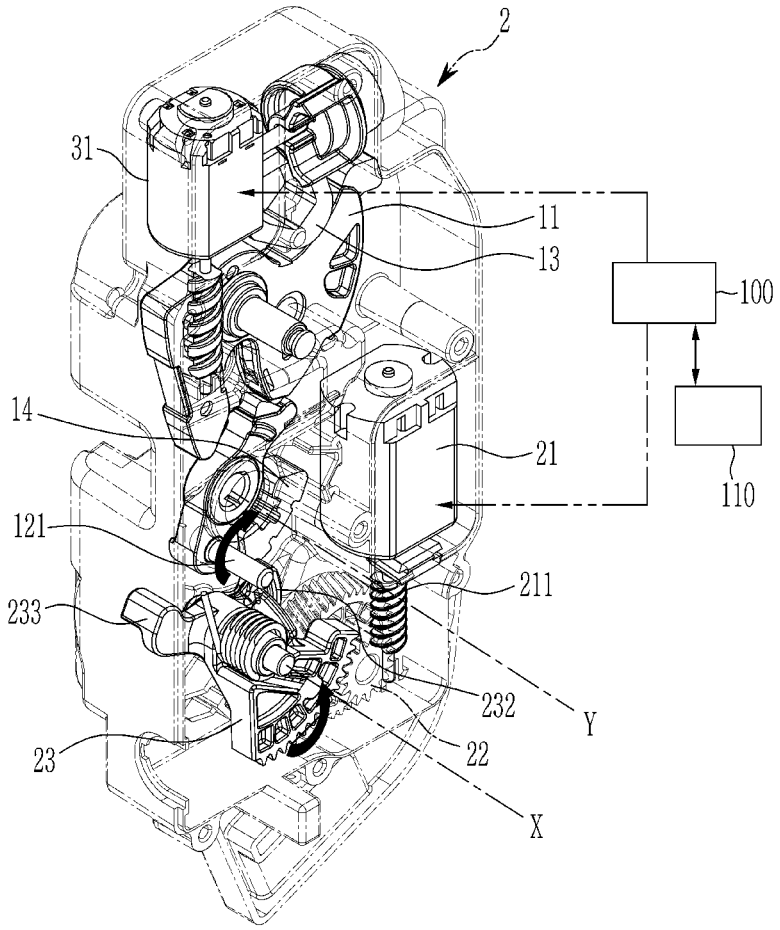
FIG. 5 illustrates how a door locking and release part of a motor-driven door latch for a vehicle is operated according to an exemplary embodiment of the present invention.

As illustrated in FIG. 5, when the vehicle door is closed, when the user operates the inside handle 354, the outside handle 364, a button or a switch, or the like, a door latch controller 100 detects it and operates the main motor 21. Then, the first driven gear 22, the second driven gear 231, and the pawl release lever 23 rotate together as the driving gear 211 rotates in a direction by the operation of the main motor 21.

When the pawl release lever 23 rotates counterclockwise around a pawl release lever rotation center X, the opening protrusion 232 contacts the pawl arm 121 to push the pawl arm 121. Then, the pawl 12 is rotated clockwise around a pawl rotation center Y through the pawl arm 121 to deviate from the rotation trajectory of the catch 11 to allow the catch 11 to be freely rotatable, so that the door can be opened.

On the other hand, when the door ratchet controller 100 applies an operation signal to the main motor 21 by a user's button or switch manipulation to rotate the driving gear 211 in another direction, the pawl release lever 23 rotates clockwise around the pawl release lever rotation center X, and the closing protrusion 233 contacts the pawl arm 121 to push the pawl arm 121. Then, the pawl 12 rotates counterclockwise around the pawl rotation center Y through the pawl arm 121 to enter the rotation trajectory of the catch 11 to stop the rotation of the catch 11 so that the door may not be opened.

The emergency door release part 30 includes an emergency auxiliary motor 31, an emergency key lever 32, a master locking link 33, a key nut 34, an inside emergency operation lever 35, and an outside emergency operation lever 36.

The emergency auxiliary motor 31 is mounted in the base plate 1, and may include a driving screw 311. A driven screw lever 312 may be engaged with the driving screw 311 to move along a longitudinal direction of the driven screw lever 312, e.g., up and down.

The emergency key lever 32 may be coupled with the driven screw lever 312, to move together with the driven screw lever 312.

The master locking link 33 has a first end connected to the emergency key lever 32 to move together with the emergency key lever 32.

A connection protrusion 331 is formed at a first end of the master locking link 33, and a hole 325 into which the connection protrusion 331 is inserted is formed at a first end of the emergency key lever 32, so that the master locking link 33 is not only connected to move together with the emergency key lever 32, but is also connected to the emergency key lever 32 to be relatively rotatable.

An operation protrusion 332 may be provided at a second end of the master locking link 33, and may be inserted into a long hole 361 formed in the outer emergency operation lever 36 to move along the long hole 361.

The key nut 34 may be coupled to a key cylinder capable of having a vehicle key inserted therein to rotate according to a rotation operation of the vehicle key.

An accommodation groove may be formed in a circumferential direction in the key nut 34, and may be divided by two accommodation groove walls 341.

A connection protrusion 322 inserted into the accommodation groove 342 of the key nut 34 is formed at a second end of the emergency key lever 32 (see FIG. 2), and when the emergency key lever 32 moves up and down, the connection protrusion 322 moves within the accommodation groove 342. However, when the key nut 34 is rotated beyond a width of the accommodation groove by the operation of the vehicle key, the emergency key lever 32 may be forcibly pushed by the connection protrusion 322 of the emergency key lever 32 and the receiving groove wall 341 to allow the emergency key lever 32 to be forcibly moved by the key nut 34.

The inside emergency operation lever 35 may be rotatably fastened to the extension arm 161 of the support bracket 16 through a pin 37.

A cable hole 351 through which a cable 353 (see FIG. 6 and FIG. 7) connected to an inside handle 354 (see FIG. 6 and FIG. 7) mounted to the vehicle door may be formed in the inside emergency operation lever 35.

A protruding arm 352 protruding at a predetermined height may be formed in the inside emergency operation lever 35.

The outside emergency operation lever 36 may also be rotatably fastened to the extension arm 161 through the pin 37.

A cable hole 362 through which a cable 363 (see FIG. 6 and FIG. 7) connected to an outside handle 364 (see FIG. 6 and FIG. 7) mounted to the vehicle door may be formed in the outside emergency operation lever 36.

A length h1 of the long hole 361 of the outside emergency operation lever 36 may be larger than a height h2 of the protruding arm 352 of the inside emergency operation lever 35. Accordingly, in the drawing, when the operation protrusion 332 is positioned below the long hole 361, the operation protrusion 332 may push the protruding arm 352.

Figure 6:
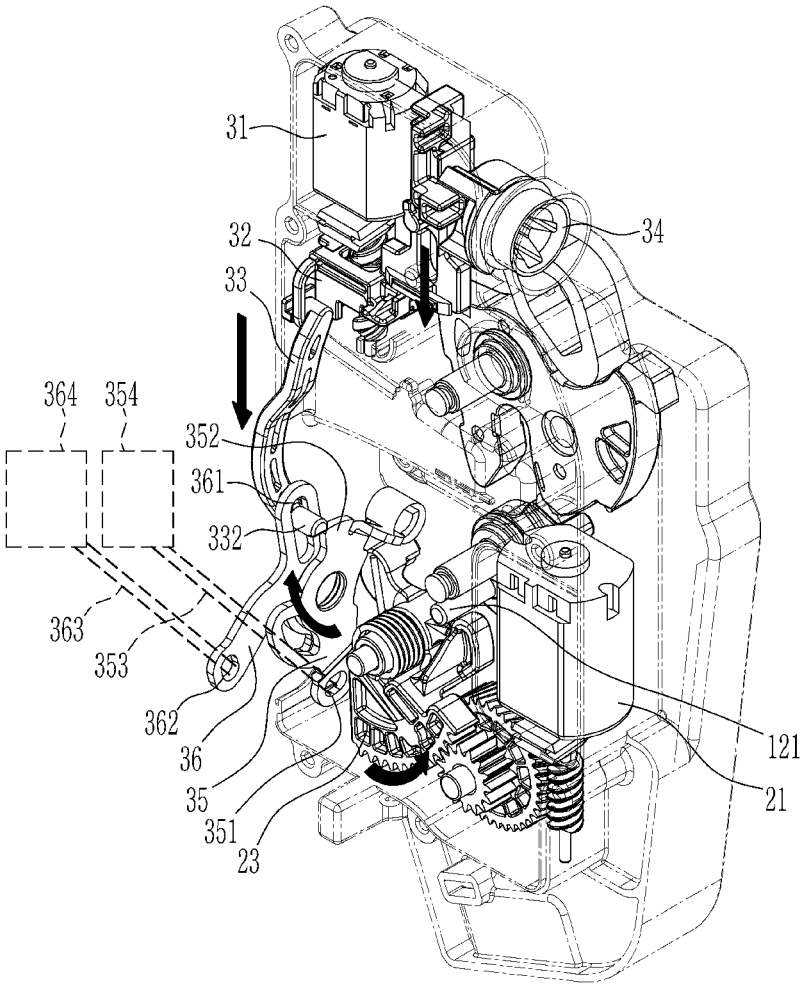
FIG. 6 illustrates how an emergency door release part using an emergency auxiliary motor for a motor-driven door latch for a vehicle is operated according to an exemplary embodiment of the present invention.

Accordingly, as illustrated in FIG. 5 and FIG. 6, when the main motor 21 is inoperable due to a collision accident of the vehicle, the door latch controller 100 may detect the inoperability of the main motor 21, for example, may detect collision through a collision detection sensor 110, to apply an operation signal to the emergency auxiliary motor 31. Then, the emergency auxiliary motor 31 rotates the driving screw 311.

Accordingly, the emergency key lever 32 and the master locking link 33 move together by the movement of the driven screw lever 321 by the driving screw 311. The operation protrusion 332 of the master locking link 33 moves along the long hole 361 of the outside emergency operation lever 36, and is disposed close to the protruding arm 352 of the inside emergency operation lever 35. (Door opening standby state)

When an occupant of the vehicle manipulates, e.g., pulls, the inside handle 354 installed in a door of the vehicle to open the door in a door opening standby state, the inside emergency operation lever 35 connected to the inside handle 354 through a cable 353 rotates. Then, the inside emergency operation lever 35 presses the closing protrusion 233 of the pawl release lever 23 to rotate the pawl release lever 23 counterclockwise around the pawl release lever rotation center X (see FIG. 5), and also to rotate the opening protrusion 232 of the pawl release lever 23 counterclockwise. Then, the opening protrusion 232 contacts the pawl arm 121 and pushes the pawl arm 121 clockwise, and the pawl 12 is rotated clockwise around the pawl rotation center Y through the pawl arm 121 to deviate from the rotation trajectory of the catch 11 to allow the catch 11 to be freely rotatable, so that the door can be opened.

When a user manipulates, e.g., pulls, the outside handle 364 installed in the door of the vehicle in the door opening standby state, the outside emergency operation lever 36 connected with the outside handle 364 through the cable 363 rotates, and the operation protrusion 332 of the master locking link 33 rotates according to the rotation of the outside emergency operation lever 36 to push the protruding arm 352 of the inside emergency operation lever 35, thereby rotating the inside emergency operation lever 36, and thus the door can be opened as in the aforementioned case of manipulating the inside handle 354.

On the other hand, when the main motor 21 and the emergency auxiliary motor 31 are simultaneously inoperable, the door locked to the vehicle body may be unlocked using a vehicle key.

Figure 7:
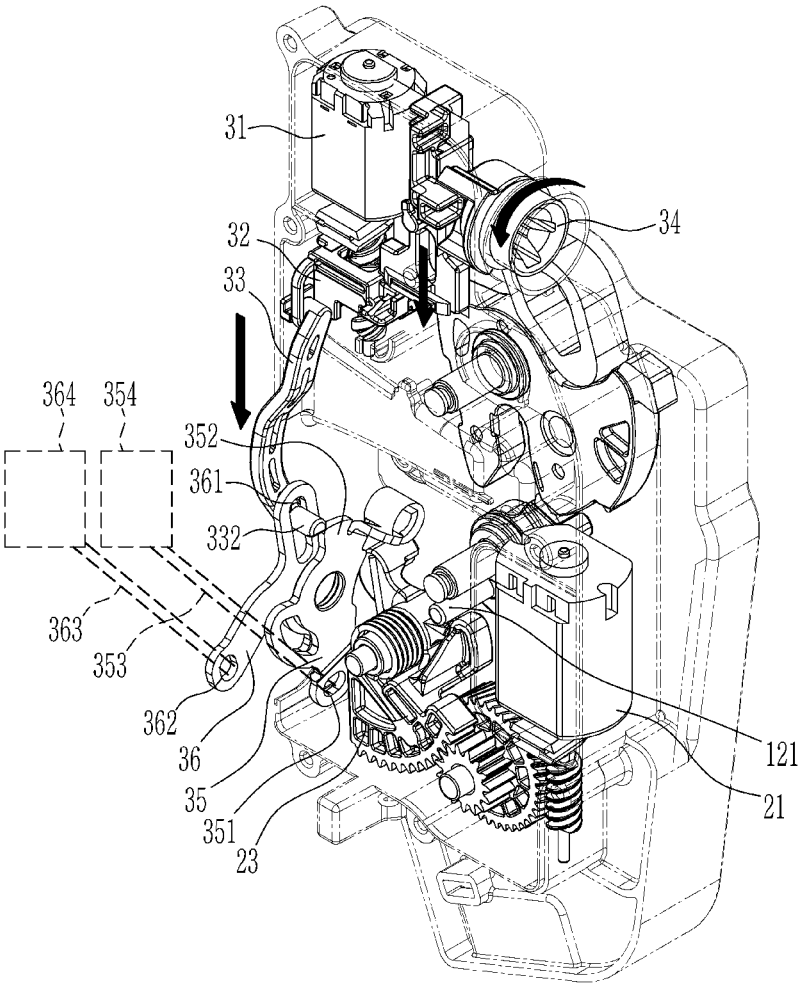
FIG. 7 illustrates how an emergency door release part using a vehicle key for a motor-driven door latch for a vehicle is operated according to an exemplary embodiment of the present invention.

That is, as illustrated in FIG. 7, when a user of a vehicle inserts a vehicle key into a key cylinder and rotates the key nut 34 by rotating it, the emergency key lever 32 and the master locking link 33 are pushed by the accommodating groove wall 341 of the key nut 34 to allow it to be in the door opening standby state, and in this state, when an occupant or the user manipulates the inside handle 354 or the outside handle 364, as described above, the inside emergency operation lever 35 or the outside emergency operation lever 36 may be operated to open the door.

While this invention has been described in connection with what is presently considered to be practical exemplary embodiments, it is to be understood that technical aspects of the present invention are not limited to the exemplary embodiments suggested in the specification, but, although a person of ordinary skill in this field of art who understands the technical aspects of the present invention can suggest another exemplary embodiment by modifications, changes, removal, and addition of constituent elements within a range of technical aspects that are the same as in the present invention, it will also be within a range of rights of the present invention.

What is claimed is:

1. A motor-driven door ratchet for a vehicle, the door ratchet comprising:

a catch part configured to lock a vehicle door to a vehicle body by being caught by a striker mounted on the vehicle body or to be detached from the striker to allow the vehicle door to be opened from the vehicle body;

a door locking and release part that includes a main motor, the door locking and release part configured to allow the catch part to be locked or released from the striker by applying a rotational force to the catch part through the main motor;

an emergency door release part that includes an auxiliary motor, the emergency door release part configured to allow the auxiliary motor to be operated to open the vehicle door from the vehicle body through the catch part;

an inside emergency operation lever connected to an inside handle installed in the vehicle door, the inside emergency operation lever configured to be rotated by receiving a manipulation force to allow the vehicle door to be opened by applying torque to the catch part;

an outside emergency operation lever connected to an outside handle installed in the vehicle door, the outside emergency operation lever configured to be rotated by receiving a manipulation force to allow the vehicle door to be opened by applying torque to the catch part; and a door latch controller configured to detect collision and to apply an operation signal to the auxiliary motor when the main motor is inoperable due to a collision accident of the vehicle.

2. The door ratchet of claim 1, wherein the catch part comprises:

a catch configured to be rotatably installed to have a locking groove through which the striker mounted on the vehicle body is inserted to be caught or is removed; and a pawl rotatably mounted to enter a rotation trajectory of the catch to stop rotation of the catch or to deviate from the rotation trajectory of the catch to allow the catch to be freely rotatable, wherein a pawl arm protruding from a first side surface is formed in the pawl.

3. The door ratchet of claim 2, further comprising a first bumper configured for damping and rotation stopping of the catch when the striker is inserted into the locking groove of the catch.

4. The door ratchet of claim 2, further comprising a second bumper configured for damping and rotation stopping of the pawl during rotation of the pawl.

5. The door ratchet of claim 2, wherein the catch and the pawl are rotatably mounted to a support bracket through pins and an extension arm is formed in the support bracket.

6. The door ratchet of claim 5, wherein the inside emergency operation lever and the outside emergency operation lever are rotatably fastened to the extension arm of the support bracket through the pins.

7. A motor-driven door ratchet for a vehicle, the door ratchet comprising:

a catch configured to be rotatably installed to have a locking groove through which a striker mounted on a vehicle body is inserted to be caught or is removed;

a pawl rotatably mounted to enter a rotation trajectory of the catch to stop rotation of the catch or to deviate from the rotation trajectory of the catch to allow the catch to be freely rotatable, wherein a pawl arm protruding from a first side surface is formed in the pawl, the catch and the pawl being part of a catch part that is configured to lock a vehicle door to the vehicle body;

a main motor configured to be rotatable in a clockwise and counterclockwise direction, the main motor including a first driving gear, wherein the catch part can be locked or released from the striker by applying a rotational force to the catch part through the main motor;

a first driven gear engaged in the first driving gear;

a pawl release lever configured to include a second driven gear engaged in the first driven gear to rotate the pawl while rotating through a driving gear of the main motor, the first driven gear, and the second driven gear;

an emergency door release part that includes an auxiliary motor, the emergency door release part configured to allow the auxiliary motor to be operated to open the vehicle door from the vehicle body through the catch part;

an inside emergency operation lever connected to an inside handle installed in the vehicle door, the inside emergency operation lever configured to be rotated by receiving a manipulation force to allow the vehicle door to be opened by applying torque to the catch part;

an outside emergency operation lever connected to an outside handle installed in the vehicle door, the outside emergency operation lever configured to be rotated by receiving a manipulation force to allow the vehicle door to be opened by applying torque to the catch part; and a door latch controller configured to detect collision through a collision detection sensor to apply an operation signal to the auxiliary motor when the main motor is inoperable due to a collision accident of the vehicle;

wherein the emergency door release part comprises:

an emergency auxiliary motor configured to include a driving screw;

a driven screw lever engaged with the driving screw to move according to rotation of the driving screw;

an emergency key lever coupled to the driven screw lever to move together therewith; and a master locking link connected to the emergency key lever together therewith to be connected to the outside emergency operation lever.

8. The door ratchet of claim 7, wherein the pawl release lever includes an opening protrusion and a closing protrusion spaced from each other in a circumferential direction; and the pawl arm is disposed between the opening protrusion and the closing protrusion.

9. The door ratchet of claim 7, wherein the door latch controller is configured to detect an operation or manipulation of a button or a switch installed in the inside handle, the outside handle, or the vehicle door to apply an operation signal to the main motor.

10. The door ratchet of claim 7, wherein a connection protrusion is formed at a first end of the master locking link;

a hole into which the connection protrusion is inserted is formed at a first end of the emergency key lever; and the master locking link is not only connected to the emergency key lever to move together therewith, but is also relatively rotatably connected to the emergency key lever.

11. The door ratchet of claim 7, further comprising a key nut coupled to a key cylinder into which a vehicle key is to be inserted, wherein an accommodation groove wall for constituting an accommodation groove is formed in a circumferential direction in the key nut, and a connection projection inserted into the accommodation groove of the key nut is formed at a second end of the emergency key lever.

12. The door ratchet of claim 7, wherein a connection protrusion is provided at a first end of the master locking link; and a long hole into which an operation protrusion is movably inserted is formed in the outside emergency operation lever.

13. The door ratchet of claim 12, wherein a protruding arm protruding at a predetermined height is formed in the inside emergency operation lever; and the protruding arm is selectively pushed by the operation protrusion of the master locking link.

14. The door ratchet of claim 13, wherein a length of the long hole of the outside emergency operation lever is larger than a height of the protruding arm of the inside emergency operation lever.

15. The door ratchet of claim 7, wherein the door latch controller is further configured to detect an operation or manipulation of a button or a switch installed in the inside handle, the outside handle, or the vehicle door to apply an operation signal to the main motor.

16. A vehicle comprising:

a vehicle body;

a collision detection sensor;

a striker mounted on the vehicle body;

a vehicle door rotatably connected to the vehicle body;

a catch part configured to lock the vehicle door to the vehicle body by being caught by the striker or to be detached from the striker to allow the vehicle door to be opened from the vehicle body;

a door locking and release part that includes a main motor, the door locking and release part configured to allow the catch part to be locked or released from the striker by applying a rotational force to the catch part through the main motor;

an emergency door release part that includes an auxiliary motor, the emergency door release part configured to allow the auxiliary motor to be operated to open the vehicle door from the vehicle body through the catch part;

an inside emergency operation lever connected to an inside handle installed in the vehicle door, the inside emergency operation lever configured to be rotated by receiving a manipulation force to allow the vehicle door to be opened by applying torque to the catch part;

an outside emergency operation lever connected to an outside handle installed in the vehicle door, the outside emergency operation lever configured to be rotated by receiving a manipulation force to allow the vehicle door to be opened by applying torque to the catch part; and a door latch controller configured to detect collision through the collision detection sensor to apply an operation signal to the auxiliary motor when the main motor is inoperable due to a collision accident of the vehicle.

17. The vehicle of claim 16, wherein the catch part comprises:

a catch configured to be rotatably installed to have a locking groove through which the striker mounted on the vehicle body is inserted to be caught or is removed; and a pawl rotatably mounted to enter a rotation trajectory of the catch to stop rotation of the catch or to deviate from the rotation trajectory of the catch to allow the catch to be freely rotatable, wherein a pawl arm protruding from a first side surface is formed in the pawl.

18. The vehicle of claim 17, wherein the door locking and release part comprises:

the main motor, which is configured to be rotatable in a clockwise and counterclockwise direction to include a first driving gear;

a first driven gear engaged in the first driving gear; and a pawl release lever configured to include a second driven gear engaged in the first driven gear to rotate the pawl while rotating through a driving gear of the main motor, the first driven gear, and the second driven gear.

19. The vehicle of claim 18, further comprising a first bumper configured for damping and rotation stopping of the catch when the striker is inserted into the locking groove of the catch.

20. The vehicle of claim 19, further comprising a second bumper configured for damping and rotation stopping of the pawl during rotation of the pawl.

* * * * *